US005561876A

United States Patent [19]

Petruzella

[11] Patent Number: 5,561,876

[45] Date of Patent: Oct. 8, 1996

[54] INFANT MATTRESS

[76] Inventor: Steven A. Petruzella, 18030 N. 66th La., Glendale, Ariz. 85308

[21] Appl. No.: 376,235

[22] Filed: Jan. 23, 1995

[51] Int. Cl.[6] ..... A47D 7/00

[52] U.S. Cl. ..... 5/724; 5/98.3; 5/201; 5/400

[58] Field of Search ..... 5/98.3, 120–123, 5/461, 468–470, 400, 200.1, 110, 111, 112, 201

[56] References Cited

U.S. PATENT DOCUMENTS

| | | | |
|---|---|---|---|
| 2,495,482 | 1/1950 | Rogatz | 155/45 |
| 2,507,848 | 5/1950 | Bashaw | 4/185 |
| 2,716,443 | 8/1955 | Laughlin | 155/182 |
| 2,807,809 | 10/1957 | Kottemann | 5/461 |
| 2,815,516 | 12/1957 | Holton | 5/461 |
| 2,836,833 | 6/1958 | Carlson | 4/185 |
| 2,924,832 | 2/1960 | Knowles | 5/468 X |
| 2,963,712 | 12/1960 | Cole | 5/200.1 X |
| 3,949,434 | 4/1976 | Anacker | 5/12 R |
| 3,949,435 | 4/1976 | Dionne | 5/327 R |
| 3,999,236 | 12/1976 | Macauley | 5/200.1 X |
| 4,663,787 | 5/1987 | Kolsch | 5/110 |
| 4,694,519 | 9/1987 | Benoit | 5/200.1 |
| 4,900,011 | 2/1990 | Nolet | 272/65 |
| 5,305,483 | 4/1994 | Watkins | 5/469 X |

*Primary Examiner*—Michael F. Trettel
*Attorney, Agent, or Firm*—Richard G. Harrer

[57] ABSTRACT

A mattress like structure is provided which is designed to not only give good support to an infant while sleeping, but may hopefully reduce the possibility of the infant suffocating while sleeping on its stomach. It includes a generally rectangular shaped rigid frame with a resilient, flexible fabric of special construction tightly stretched over the frame to form a top and bottom surface. The fabric is of an open mesh type with relatively large openings to provide excellent air flow to the infant. The non-open area of the fabric is such that it will support the infant in a very comfortable manner without making any creases or lines in the infant's skin. Moreover, the openings, although relatively large are not so large that the infant's fingers can be caught in the openings. The special fabric is constructed in the form of a generally rectangular shaped sleeve closed at one end and provided with a zipper or other closure means about a portion of its perimeter. The mesh sleeve may then be pulled over the frame and once it is positioned over the frame, the zipper may be used to totally enclose the special fabric mesh about the frame.

5 Claims, 1 Drawing Sheet

INFANT MATTRESS

This invention relates to the general class of structures known as mattresses, and particularly to those useful in supporting an infant in a reclining position and allowing the infant to sleep.

BACKGROUND OF THE INVENTION

The choice of a mattress to support an infant in a bed or crib is certainly important. Most of the infant mattresses are innersprings, although some are constructed of foam. An innerspring mattress usually has a metal spring unit, layers of light padding and insulators to keep the padding from migrating into the springs. The layers are then usually covered in some type of a liquid resistant ticking. A foam mattress is usually just a slab of foam inside a ticking material like that on an innerspring mattress. On such mattresses, whether foam or innerspring, the ticking is usually a layer of vinyl fabric. As the price of the mattress rises, they usually will then employ quilted vinyl or multiple layers of vinyl laminated together and reinforced with synthetic like nylon.

Sudden Infant Death Syndrome (SIDS) is said to be the leading cause of death among babies between one month and one year of age. In the United States, the rate of SIDS cases seems to be diminishing and experts attribute this to perhaps greater public awareness of preventative measures. SIDS is defined simply as the medically unexplained death of an infant or baby under age one. It has been reported that even with the decline in such deaths, over 5,000 babies each year in the United States, continue to fall victim to this syndrome. Although there has been a great amount of research over the past twenty years or so into the possible causes of SIDS, no one really knows why or how it strikes. Researchers now believe that a variety of factors may play a role, everything from sleeping position to room temperature.

There is some research that seems to indicate that the sleeping position of the infant is possibly linked to SIDS. Although this research is preliminary, the current recommendation is that babies sleep on their backs or sides, the thinking being that babies who sleep on their stomach are at higher risk. In this connection, a recent study has found that SIDS victims were nearly twelve times more likely to be discovered on their stomach than any other position. Premature infants with respiratory problems, infants who vomit and those with certain upper airway obstructions are exceptions and it is recommended that they usually should be put to sleep face down. In this connection, it is also recommended that babies not sleep on soft surfaces such as sheepskin or on a pillow since doing so may put the infant at risk for suffocation by causing the infant to rebreathe the exhaled air.

Thus, it appears that soft bedding may form a pocket around the face of the infant, forming a seal which traps air so that the baby rebreathes the same air, much like a person who breathes into a paper bag.

In view of the foregoing, it is appreciated that there is a need for an improved mattress or infant support which may serve to lessen the risk of SIDS and give other benefits while the infant is resting or sleeping.

SUMMARY OF THE INVENTION

In accordance with my invention, a mattress like structure is provided which is designed to not only give good support to an infant while sleeping, but may hopefully reduce the possibility of the infant suffocating while sleeping on its stomach. Moreover, if the infant should be ill and vomit, the construction of the mattress is such that it makes it considerably less likely that the infant might gag on the discharge.

Additionally, the very open construction of the mattress permits better air circulation about the infant which may well tend to reduce heat rash. This open construction allowing for increased air circulation may also help to reduce diaper rash in that urine which leaks out of the diaper may evaporate more quickly.

My improved infant mattress is vastly different from conventional infant mattresses as earlier described. It includes a generally rectangular shaped rigid frame with a resilient, flexible fabric of special construction tightly stretched over the frame to form a top and bottom surface. The fabric is of an open mesh type with relatively large openings to provide excellent air flow to the infant. The non-open area of the fabric is such that it will support the infant in a very comfortable manner without making any creases or lines in the infant's skin. Moreover, the openings, although relatively large are not so large that the infant's fingers can be caught in the openings. Preferably, the special fabric is constructed in the form of a generally rectangular shaped sleeve closed at one end and provided with a zipper or other closure means about a portion of its perimeter. The mesh sleeve may then be pulled over the frame and once it is positioned over the frame, the zipper may be used to totally enclose the special fabric mesh about the frame.

DETAILED DESCRIPTION OF A PREFERRED EMBODIMENT

Figure 1:
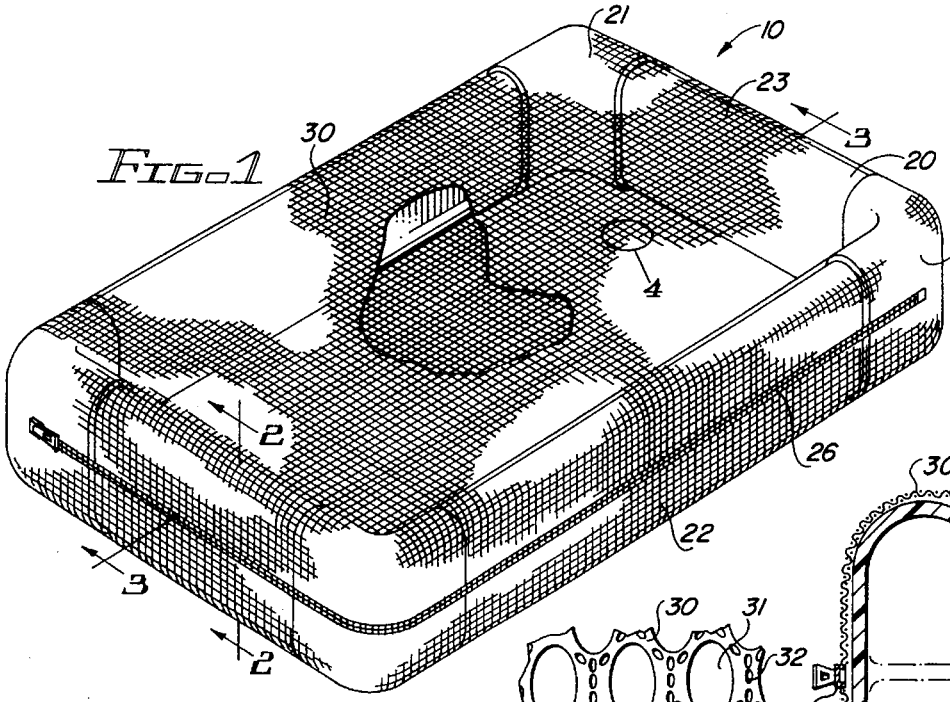
FIG. 1 is a perspective view of a preferred embodiment of the infant mattress of this invention.
Figure 2:
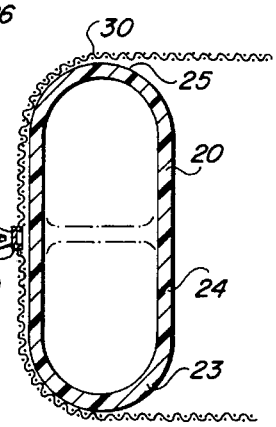
FIG. 2 is a cross-sectional view taken on line 2—2 of FIG. 1.

As shown in FIG. 1, the numeral 10 designates a preferred embodiment of the infant mattress which includes a generally rectangular shaped frame 20 with the frame completely covered by a tightly stretched but flexible and resilient open mesh fabric 30.

Figure 6:
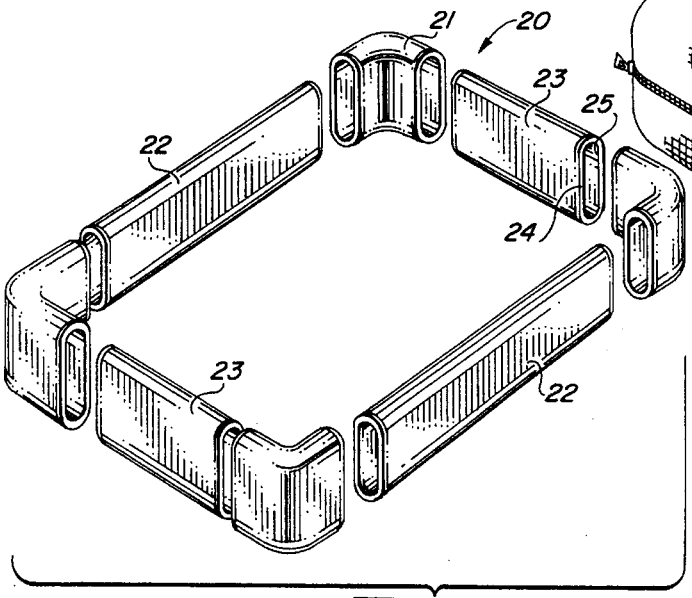
FIG. 6 is a perspective view of the frame of the mattress of this invention.

As shown best in FIG. 6, frame 20 is of a generally rectangular shape and can be of a length and width which will fit into a standard size crib. Preferably, frame 20 is constructed of a rigid tubular plastic material such as polyvinylchloride and, is of a type that is easily assembled and disassembled into its component parts. As shown, frame 20 includes a pair of opposed sides 22, a pair of opposed ends 23 and four 90° elbows 21 which serve to connect the sides and ends to form the rectangular frame. In a preferred embodiment, each of sides 22 and ends 23 are frictionally engaged into elbows 21. It is also preferred that dimensionally the height of each frame component be greater than its width. Thus, for example, end 23 has a pair of opposed straight sides 24 and opposed rounded ends 25. This same construction is to be found in all of the frame components, sides, ends and elbows. A dimension of about 2"in width by 5" in height works well for the components.

It is not necessary that the frame components be secured together by means of an adhesive, and in fact, it is preferred that an adhesive not be used so that the frame may be easily disassembled and then reassembled. As will later be explained, there is little or no possibility of the frame accidentally coming apart when it is covered by the fabric 30.

Figure 4:
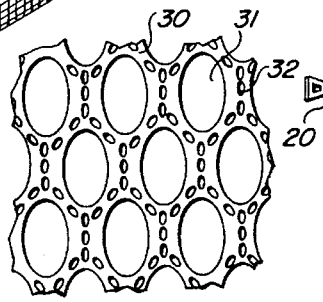
FIG. 4 is a partial but enlarged view of a preferred open mesh fabric useful in the present invention.
Figure 3:
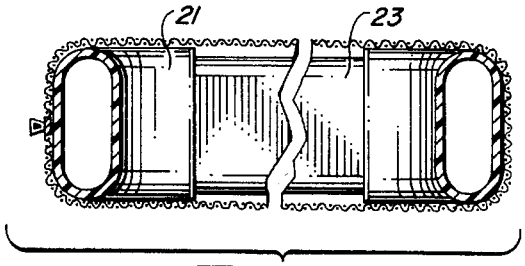
FIG. 3 is a cross-sectional view taken on the plane of the line 3—3 of FIG. 1.

Fabric 30 which covers frame 20 is of a special construction to provide enhanced air flow to the infant. As shown in FIG. 4, the fabric is of an open mesh construction with generally circular or oval shaped openings 31. Each of the openings is separated on all sides by fabric 32, which is not the typical netting found in some prior art structures. Since the infant will be sleeping on the fabric, it is important to the infant's comfort that there be a relatively wide band or area of fabric surrounding each opening 31. Preferably the distance between opening 31 and therefore the width of fabric between adjacent openings should range from about 3/16" to about 5/16" with 1/4" preferred. Using an open mesh fabric having the foregoing specification allows the infant to comfortably sleep on the surface of the fabric without it making creases or indentations in the infant's skin. Additionally, the size of the opening should be such that the infant's fingers will not get caught in the openings. Openings of a diameter of about 1/8" to about 1/4" with 3/16" being preferred. I prefer that the mesh be made of nylon fiber.

Figure 5:
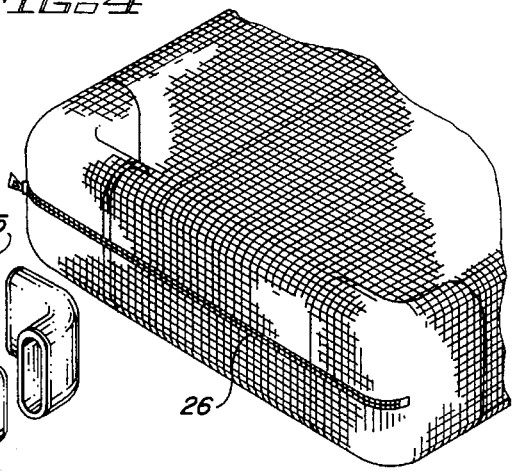
FIG. 5 is a partial perspective view of the one end of the infant mattress of this invention.

As shown in FIGS. 1, 2, 3 and 5, the open mesh fabric 30 completely covers frame 20 and is constructed in the form of a generally rectangular shaped sleeve provided with closure means such as a zipper 26. As shown in FIG. 1 the closure (zipper 26) can extend along one end and side or, as shown in FIG. 5, can extend along one end. Having the fabric component constructed in the form of a sleeve provides several advantages. Firstly, the infant may sleep on either the top or bottom sides of the mattress, that is, the mattress is reversible. The sleeve type construction also enables the fabric member to be easily removed from the frame or mounted around the frame. Also, once the fabric member 30 is in place and the zipper has been closed, the fabric completely surrounds the frame and there is tension on the frame components which means the frame components will not come apart, even though no adhesive is used to secure the frame components together.

Another feature of my infant mattress is its portability. As earlier described, fabric 30 in sleeve form is easily removed from frame 20. Once the fabric is removed. The frame can be disassembled into components 21, 22 and 23 and is then easily transported to another location and reassembled. Additionally, although a preferred size is that of a standard crib (about 52"×27"), a smaller version would also be very useful and could easily be carried in a vehicle in assembled form.

From the foregoing description, it will be seen that this invention provides a mattress like structure for use with infants which gives superior air flow to and about the infant even when the infant is sleeping on its stomach. Additionally, the relatively large openings in the fabric infants who vomit frequently provide a passageway for getting rid of the discharge.

I claim:

1. A mattress like structure particularly adapted to support an infant and having a generally rectangular shaped rigid frame, said frame being completely covered on its top, bottom and sides by a tightly stretched, resilient, open mesh fabric in the form of a sleeve having closure means in a portion of its perimeter whereby said fabric sleeve may be readily removed from or mounted about said frame, said mesh further provided with spaced apart openings having a diameter of from about 1/8 to about 1/4 inches with a band of fabric surrounding each opening, said band ranging from about 3/16 to about 5/16 inches in width.

2. The structure of claim 1 wherein said frame includes as separate components a pair of opposed sides and a pair of opposed ends joined to form said frame by means of elbows.

3. The structure of claim 2 wherein said frame components are tubular, frictionally engaged one to the other, having a height greater than its width, and easily disassembled into said separate components.

4. The structure of claim 3 wherein said openings have a diameter of about 3/16 inches and wherein said fabric band is about 1/4 inches.

5. The structure of claim 3 wherein said sleeve serves to both support an infant and to provide tension on said frame components and thereby secure the components together.

* * * * *